US008998648B2

(12) United States Patent
Zhang

(10) Patent No.: US 8,998,648 B2
(45) Date of Patent: Apr. 7, 2015

(54) AUDIO JACK CONNECTOR

(71) Applicant: Hon Hai Precision Industry Co., Ltd., New Taipei (TW)

(72) Inventor: Wei-De Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 112 days.

(21) Appl. No.: 13/905,394

(22) Filed: May 30, 2013

(65) Prior Publication Data

US 2014/0038467 A1 Feb. 6, 2014

(30) Foreign Application Priority Data

Aug. 6, 2012 (CN) ..... 2012 1 0276582

(51) Int. Cl.
*H01R 24/04* (2006.01)
*H01R 24/38* (2011.01)
*H01R 24/58* (2011.01)

(52) U.S. Cl.
CPC ..... *H01R 24/38* (2013.01); *H01R 24/58* (2013.01)

(58) Field of Classification Search
CPC ..... H01R 24/38; H01R 24/58
USPC ..... 439/668, 669
See application file for complete search history.

(56) References Cited

U.S. PATENT DOCUMENTS

| | | | | |
|---|---|---|---|---|
| 6,524,138 | B1 | 2/2003 | Li et al. | |
| 6,808,404 | B1 * | 10/2004 | Doyle et al. | 439/188 |
| 7,031,486 | B2 | 4/2006 | Hu | |
| D534,493 | S * | 1/2007 | Lin | D13/133 |
| 8,123,569 | B2 | 2/2012 | Little et al. | |
| 8,616,922 | B2 * | 12/2013 | Liu et al. | 439/669 |
| 2008/0280499 | A1 | 11/2008 | Miki et al. | |

* cited by examiner

*Primary Examiner* — Khiem Nguyen
(74) *Attorney, Agent, or Firm* — Ming Chieh Chang; Wei Te Chung

(57) ABSTRACT

An audio jack connector (100) includes an insulative housing (2) defining a receiving space (20), a number of signal contacts (31, 32) retained in the insulative housing, and a pair of griping contacts (33) retained in the insulative housing too. The signal contacts have a number of first contacting portions (311, 321) extending into the receiving space from a left-and-right direction perpendicular to a mating direction along which an audio plug connector is inserted into the receiving space. The gripping contacts have at least three second contacting portions (332, 333/3331) extending into the receiving space from a vertical direction perpendicular to both the left-and-right direction and the mating direction.

11 Claims, 6 Drawing Sheets

AUDIO JACK CONNECTOR

BACKGROUND OF THE INVENTION

1. Field of the Invention

The present invention relates generally to an audio jack connector, and more particularly to an audio jack connector stably connected with an audio plug connector.

2. Description of Related Arts

U.S. Pat. No. 8,123,569 discloses an audio jack connector comprising an insulative housing defining a receiving space, and a plurality of contacts retained in the insulative housing. The contacts comprise a number of signal contacts and a pair of griping contacts. The griping contacts are symmetrically and respectively located at left and right sides of the receiving space. The griping contacts have a pair of opposing contacting portions extending into the receiving space from opposite left and right directions. The griping contacts are used for retaining the audio plug connector in the receiving space. The audio plug connector may deviate from an appropriate position in a left-and-right direction when undertaking an unbalanced force from the griping contacts. Since the signal contacts are arranged at left and right sides of the receiving space, signal transmission between the audio jack connector and the audio plug connector may be interrupted or poor contact therebetween may result.

U.S. Pat. No. 7,031,486 discloses an audio jack connector comprising a first contact member, a second contact member, and a third contact member. Each of the first contact member and the second contact member has a contact boss to contact with an inserted plug from a top side of the plug. The third contact has a base portion with upper and lower edges and a pair of prongs that extend from the upper edge of the base portion. The prongs have distal end parts extending into a plug insertion space from respective left and rights sides of the plug insertion space. Because the distal end parts are just two points, the plug is not firmly retained by the distal end parts along the left- and right direction. The plug may downwardly deviate away from the contacting bosses of the first and second contact.

Hence, an audio jack connector having signal contacts capable of reliably connecting with an inserted audio plug connector is desired.

SUMMARY OF THE INVENTION

Accordingly, an object of the present invention is to provide an audio jack connector having signal contacts reliably connected with an audio plug connector even if the audio plug connector is deviated.

To achieve the above object, an audio jack connector includes an insulative housing defining a receiving space, a number of signal contacts retained in the insulative housing, and a pair of griping contacts retained in the insulative housing too. The signal contacts have a number of first contacting portions extending into the receiving space from a left-and-right direction perpendicular to a mating direction along which an audio plug connector is inserted into the receiving space. The gripping contacts have at least three second contacting portions extending into the receiving space from a vertical direction perpendicular to both the left-and-right direction and the mating direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1 to 6, an audio jack connector 100 of the present invention, includes an insulative housing 2 and a plurality of contacts 3 retained in the insulative housing 2.

Figure 1:
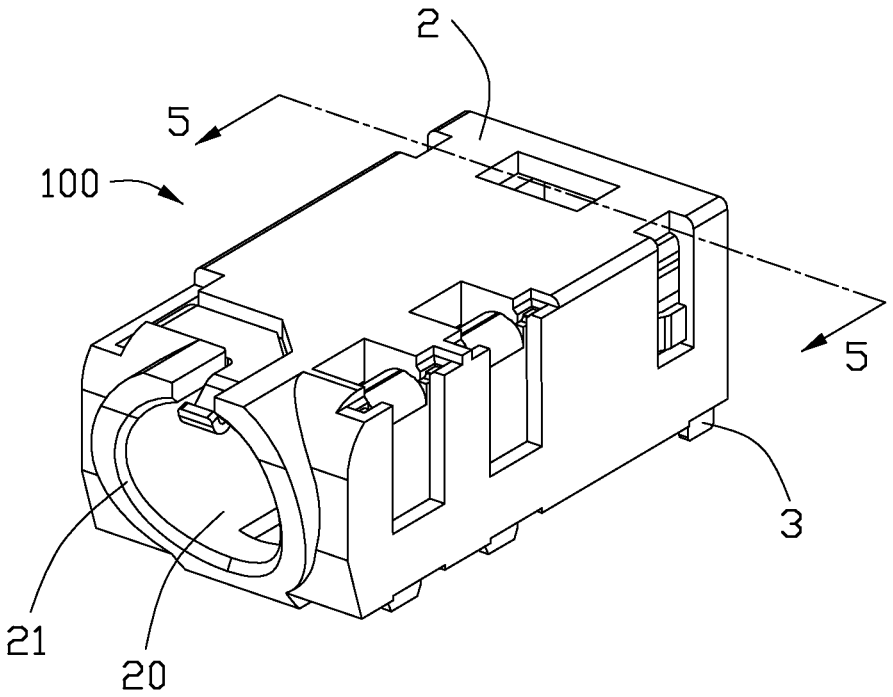
FIG. 1 is a perspective, assembled view of an audio jack connector according to the present invention.
Figure 2:
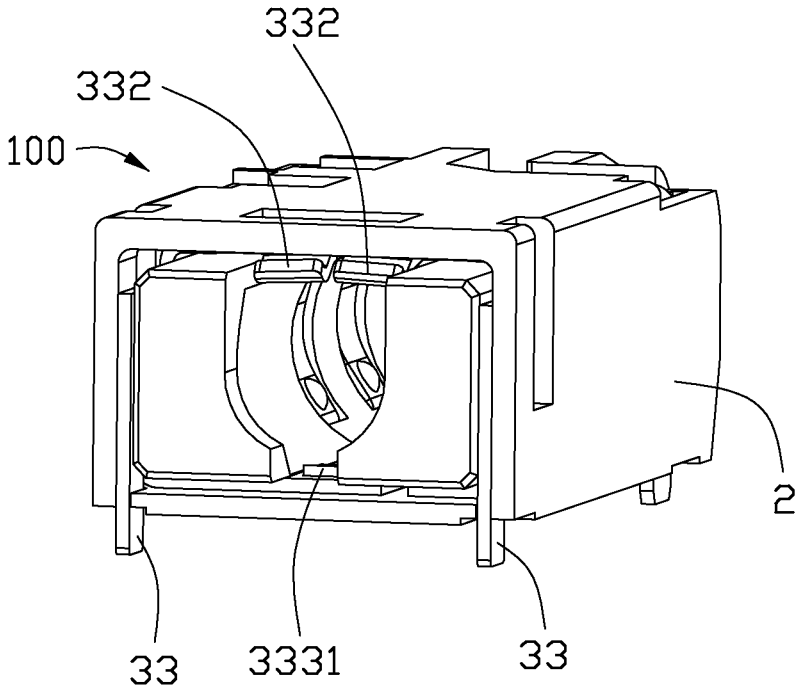
FIG. 2 is another perspective, assembled view of the audio jack connector.
Figure 3:
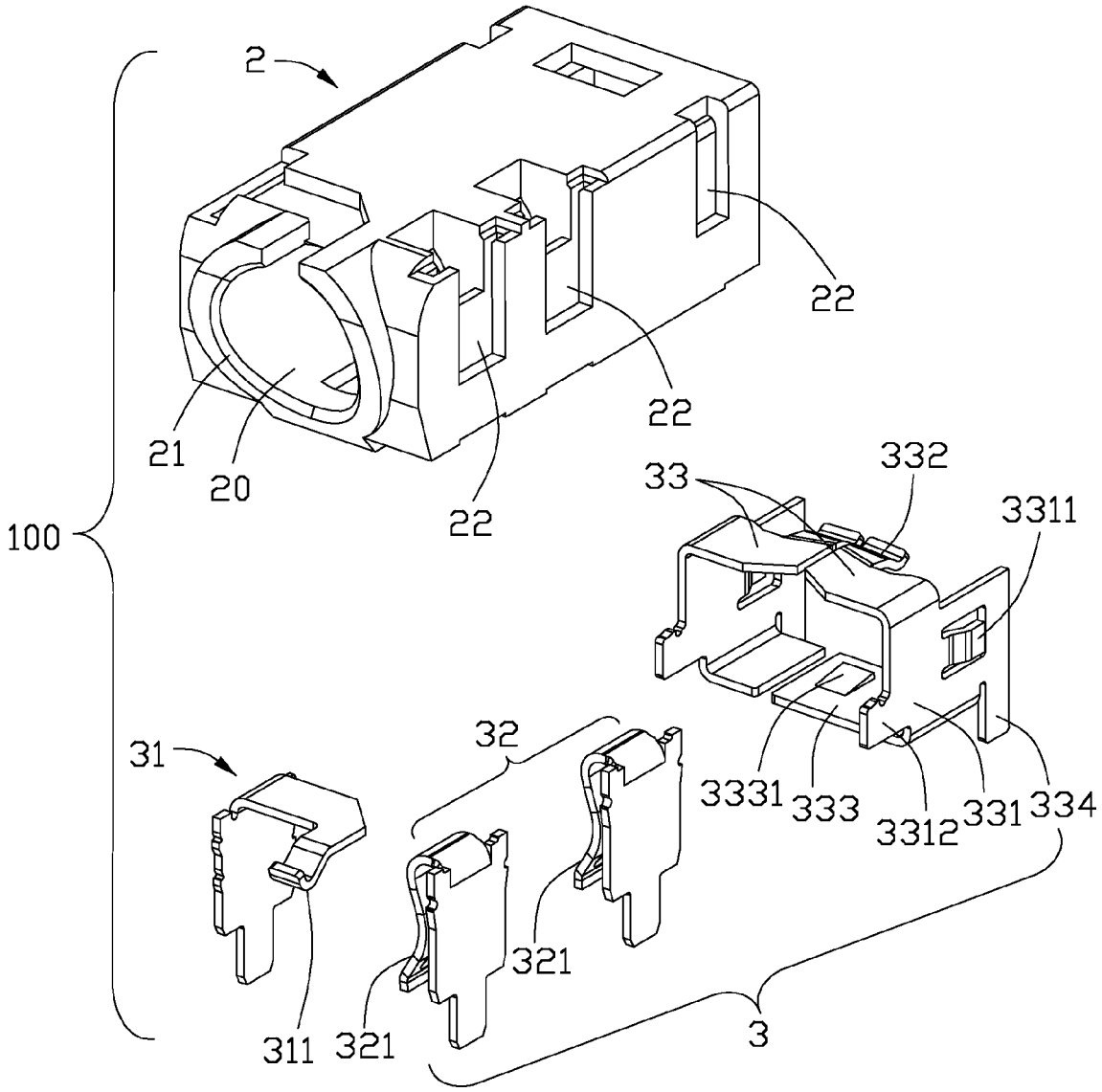
FIG. 3 is a perspective, exploded view of the audio jack connector.
Figure 4:
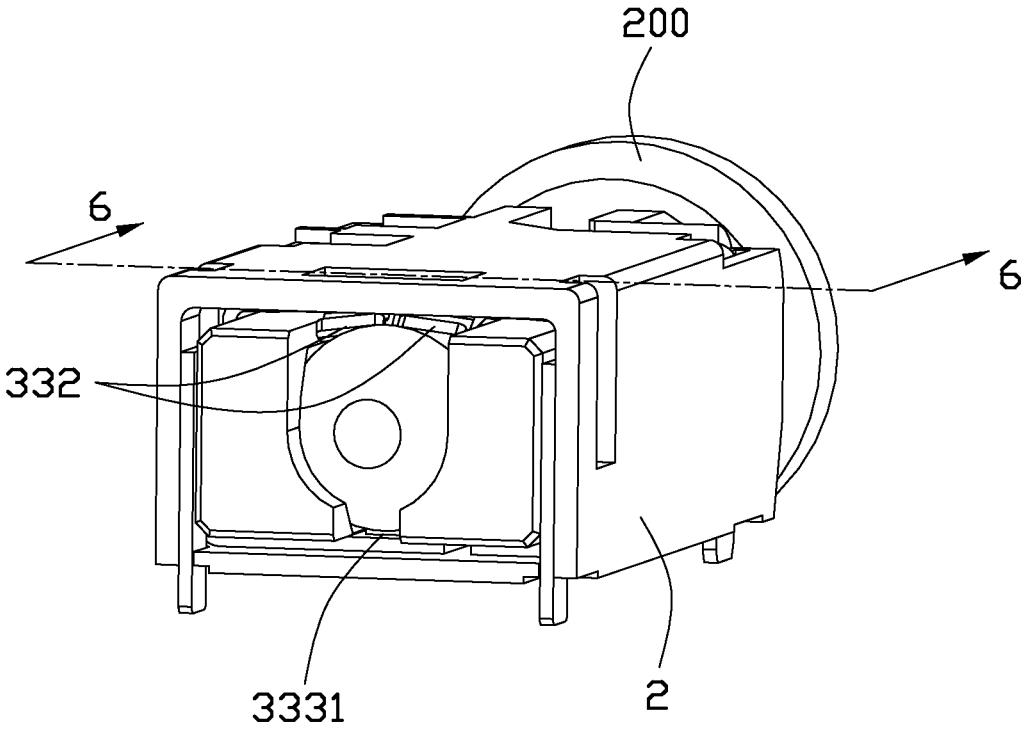
FIG. 4 is a perspective, assembled view of the audio jack connector and an audio plug connector inserted in the audio jack connector.

Referring to FIGS. 3 and 4, the insulative housing 2 is rectangular and defines a receiving space 20 and an insertion opening 21 through which an audio plug connector 200 is inserted into the receiving space 20. The insulative housing 2 also defines a plurality of passageways 22 around the receiving space 20 for retaining the contacts 2.

Referring to FIG. 4, the contacts 3 comprises a grounding contact 31, a pair of signal contacts 32, and a pair of griping contacts 33 for retaining the audio plug connector 200. The grounding contact 31 is nearest to the insertion opening 21 of all the contacts 3 for timely discharging static electricity when the audio plug connector 200 is initially inserted into the receiving space 20 of the audio jack connector 100. The griping contacts 33 are farthest from the insertion opening 21 of all the contacts 3. The signal contacts 32 are located between the grounding contact 21 and the griping contacts 33. Therefore, the griping contacts 33 are not engaged with corresponding portions of the audio plug connector 200 until the signal contacts 32 electrically connect with corresponding electrical pads of the audio plug connector 200. The grounding contact 31 has a first contacting portion 311 at a top of the insertion opening 21. Each signal contact 32 has a second contacting portion 321 at respective left or/and right sides of the receiving space 20. Therefore, the second contacting portions 321 of the signal contacts 32 are engaged with the audio plug connector 200 from left/right sides of the audio plug connector 200. Connection between the signal contacts 32 and the audio plug connector 200 is rarely influenced by deviation of the audio plug connector 200 in no left-and-right direction.

Figure 5:
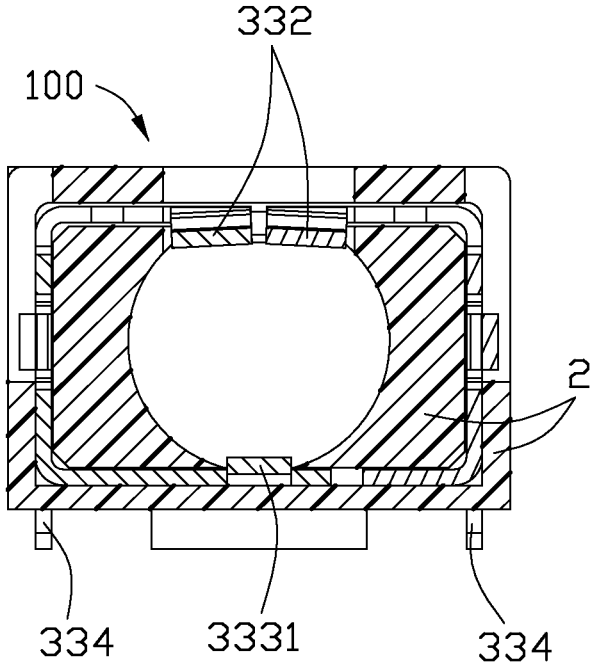
FIG. 5 is a cross-sectional view taken along line 5-5 of FIG. 1.
Figure 6:
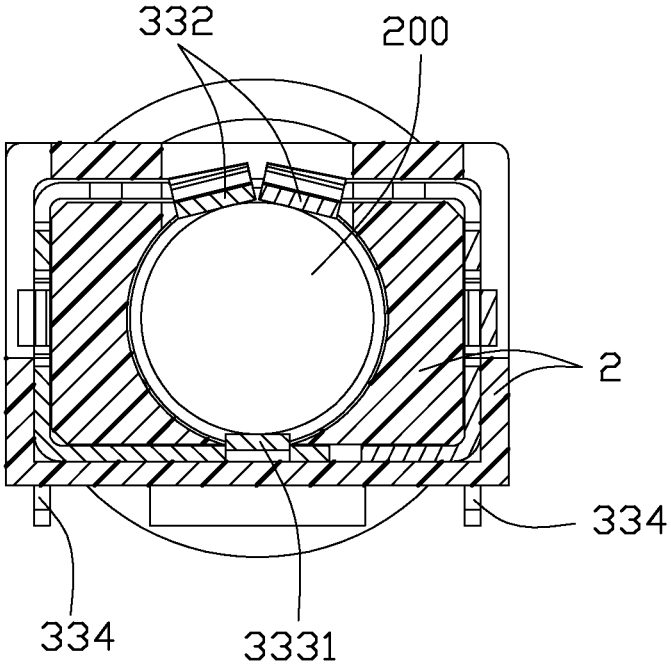
FIG. 6 is another cross-sectional view taken along line 6-6 of FIG. 4.

Referring to FIGS. 4 and 5, The griping contacts 33 are respectively located at two opposite sides of the receiving space 20 along the mating direction. Each griping contact 33 comprises an upright base portion 331, an elastic portion 332 extending upwardly and then forwardly from the base portion 331 to be located above the receiving space 20, a flat portion 333 bending from the base portion 331 to be located below the receiving space 20, and a board lock 334 extending downwardly from bottom edge of the base portion 331 for securing to a printed circuit board (not shown). The base portions 331, the elastic portions 332, and the flat portions 333 of the gripping contacts 33 are peripheral around the receiving space 20. Each elastic portion 332 forms a third contacting portion (not labeled) protruding into the receiving space 20 from a top side of the receiving space 20. The base portion 331 is stamped to form a cantilevered, flexible tongue portion 3311 for enhancing ejection force of the audio plug connector 200 from the audio jack connector 100. The base portion 331 further forms a rigid tab 3312 retained in the insulative housing 2 for positioning the griping contact 33 in the insulative housing 2. The rigid tab 3312 extends opposite to the flexible tongue portion 3311. The board lock 334 extends perpendicular to the rigid tab 3312 and the flexible tongue portion 3311. The elastic portions 332 of the griping contacts 33 are angled as viewed from a top side of the receiving space 20. Therefore, contacting area between the elastic portions 332 and the audio plug connector 200 is enlarged for more reliably retaining the audio plug connector 200 in the receiving space 20, i.e., the audio plug connector 200 is prevented from dropping from the receiving space 20. In a preferred embodiment, at least one of the flat portions 333 has at least one protrusion 3331 protruding toward the receiving space 20. The at least one protrusion 3331 of the flat portion 333 and the third contacting portion of the elastic portions 332 oppositely face toward each other for cooperatively retaining the audio plug connector 200 in the receiving space 20 along a vertical direction both perpendicular to the mating direction and the left-and-right direction.

In the audio jack connector 100 of the present invention, because the griping contacts 33 farthest away from the insertion opening 21 are actually retained the audio plug connector 200 in the receiving space 21 along the vertical direction by at least three points (the two elastic portions 332 and the at least protrusion 3331). The audio plug connector 200 is kept in its correct position to avoid deviation. Furthermore, the signal contacts 32 contact with the audio plug connector 200 along the left-and-right direction and so, even if the audio plug connector 200 is deviated for a little degree resulting in undertaking an unbalanced force in the vertical direction, electrical connection between the signal contacts 32 and the audio plug connector 200 is not influenced.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector comprising: an insulative housing defining a receiving space; a plurality of signal contacts retained in the insulative housing and having a plurality of first contacting portions extending into the receiving space from a left- and-right direction perpendicular to a mating direction along which an audio plug connector is inserted into the receiving space; and a pair of griping contacts retained in the insulative housing, each griping contact having a base portion, an elastic portion extending from the base portion to be located above the receiving space, and a flat portion bending from the base portion to be located below the receiving space, at least one of the flat portions having a protrusion protruding toward the receiving space, the two elastic portions and the protrusion extending from opposite sides into the receiving space along a vertical direction perpendicular to both the left-and-right direction and the mating direction, wherein the base portions, the elastic portions, and the flat portions of the gripping contacts are disposed peripherally around the receiving space, wherein the base portion has a stamped, cantilevered, flexible tongue portion and a rigid tab oppositely extending with respect to the tongue portion, and wherein the rigid tab is retained in the insulative housing, wherein the gripping portion has a board lock extending perpendicular to the rigid tab and the flexible tongue portion, wherein the elastic portions of the griping contacts are angled as viewed from a top side of the receiving space.

2. The audio jack connector as claimed in claim 1, wherein the signal contacts comprise a grounding contact, the grounding contact is nearest to an insertion opening of the insulative housing through which the audio plug connector is inserted into the receiving space and the griping contacts are farthest from the insertion opening.

3. An audio jack connector for use with an audio plug, comprising: an insulative housing defining opposite front and rear faces in a front-to-back direction; a plug receiving space formed in the housing with at least an opening in the front face to forwardly communicate with an exterior in said front-to-back direction, said plug receiving space essentially being of a columnar configuration with an imaginary center axis extending along said front-to-back direction; a plurality of signal contacts located by at least one side of the receiving space in a transverse direction perpendicular to said front-to-back direction, each of said signal contacts including a contacting section extending into the receiving space for contacting the audio plug in said transverse direction; and a combo contact located behind said signal contacts and defining a pair of elastic contacting portions and a protrusion commonly forming, viewed in said front-to-back direction, a three-point contact during mating with the audio plug; wherein said three point contact is configured with an isosceles triangle with thereof an imaginary vertical bisector extending through the imaginary center axis, wherein said combo contact includes a pair of griping contacts essentially arranged by two sides of the receiving space, and said pair of elastic contacting portions are respectively formed on said pair of grip contacts, respectively, wherein said pair of griping contacts are asymmetric with each other, and only one of said griping contacts defines said protrusion, wherein said pair of griping contacts are discrete from each other, and each of said pair of griping contacts is configured with a U-shape view in said front-to-back direction.

4. The audio jack connector as claimed in claim 3, wherein the housing defines a plurality of contact passageways surrounding said receiving space to receive the corresponding contacts, the passageway receiving said combo contact is configured to allow said combo contact to be forwardly inserted thereinto in the front-to-back direction from the rear face while other passageways are configured to allow the corresponding signal contacts to be inserted thereinto in a vertical direction perpendicular to both said front-to-back direction and said transverse direction.

5. The audio jack connector as claimed in claim 3, wherein both said signal contacts and said combo contact define vertical mounting tails extending downwardly beyond a mounting face of the housing.

6. The audio jack connector as claimed in claim 3, wherein said protrusion is located on said vertical bisector.

7. The audio jack connector as claimed in claim 3, wherein said three-point contact is located in a same vertical plane in which said vertical bisector is located.

8. The audio jack connector as claimed in claim 3, wherein said pair of elastic contacting sections are oblique to said vertical bisector for compliance with a contour of said columnar configuration.

9. The audio jack connector as claimed in claim 3, further including a grounding contact located around the front face and a top face opposite to a mounting face of the housing, at a position aligned with a vertical diameter of said columnar configuration.

10. The audio jack connector as claimed in claim 3, wherein a top face of said housing defines an opening to allow upward deflection of said pair of elastic contacting portions during mating.

11. An audio jack connector for use with an audio plug, comprising: an insulative housing defining opposite front and rear faces in a front-to-back direction; a plug receiving space formed in the housing with at least an opening in the front face to forwardly communicate with an exterior in said front-to-back direction, said plug receiving space essentially being of a columnar configuration with an imaginary center axis extending along said front-to-back direction; a plurality of signal contacts located by at least one side of the receiving space in a transverse direction perpendicular to said front-to-back direction, each of said signal contacts including a contacting section extending into the receiving space for contacting the audio plug in said transverse direction; and a combo contact located behind said signal contacts and defining a pair of griping contacts symmetric with each other relative to an imaginary vertical plane containing said imaginary center axis, and each of said pair of griping contacts defining at least an L-shaped configuration in a top view; wherein said L-shaped configuration includes a deflectable curved segment extending along the said front-to-back direction for contact with the audio plug, and a compliant oblique segment extending along the transverse direction for compliance with a contour of said audio plug, wherein each of said griping contacts defines a U-shaped configuration viewed in the front-to-back direction, wherein said pair of U-shaped configurations are asymmetric with each other but with a large one and a small one, and a protrusion is formed on the large one to cooperate with deflectable curved segments for forming an isosceles triangle while the small one being not equipped with said protrusion.

* * * * *